US006006440A

United States Patent [19]

Wiesenhofer et al.

[11] Patent Number: 6,006,440

[45] Date of Patent: Dec. 28, 1999

[54] PROCESS AND APPARATUS FOR DRYING A SLURRY

[75] Inventors: Wolfgang Wiesenhofer, Graz; Giselher Stummer, Kumberg, both of Austria

[73] Assignee: Andritz-Payrntverwaltungs-gesellschaft M.B.H., Austria

[21] Appl. No.: 08/974,153

[22] Filed: Nov. 19, 1997

[30] Foreign Application Priority Data

Nov. 22, 1996 [AT] Austria ..... 2033/96

[51] Int. Cl.[6] ..... F26B 5/06

[52] U.S. Cl. ..... 34/305; 34/334; 34/347; 34/378; 34/535; 34/550; 34/181

[58] Field of Search ..... 34/302, 305, 334, 34/347, 354, 378, 535, 550, 79, 132, 181; 210/770, 771, 779; 110/224, 238, 346; 432/139

[56] References Cited

U.S. PATENT DOCUMENTS

| | | | |
|---|---|---|---|
| 4,310,973 | 1/1982 | King | 34/368 |
| 4,696,115 | 9/1987 | Spadafora | 34/550 X |
| 4,970,803 | 11/1990 | Keller | 34/371 |
| 4,974,777 | 12/1990 | Dowling et al. | 34/557 X |
| 5,069,801 | 12/1991 | Girovich | 210/770 |
| 5,245,762 | 9/1993 | Hartis et al. | 34/402 |
| 5,279,637 | 1/1994 | Lynam et al. | 71/12 |
| 5,309,849 | 5/1994 | Krebs | 110/224 |
| 5,318,184 | 6/1994 | Krebs | 209/21 |
| 5,337,496 | 8/1994 | Glorioso | 34/378 |
| 5,474,686 | 12/1995 | Barr | 210/771 |
| 5,557,873 | 9/1996 | Lynam et al. | 34/379 |
| 5,611,935 | 3/1997 | Theimann et al. | 210/771 |

FOREIGN PATENT DOCUMENTS

| | | |
|---|---|---|
| 0789209 | 8/1997 | European Pat. Off. . |
| 0802381 | 10/1997 | European Pat. Off. . |
| 4242747 | 6/1994 | Germany . |
| 4321994 | 1/1995 | Germany . |
| 19531101 | 1/1997 | Germany . |
| 9324800 | 12/1993 | WIPO . |
| 9533697 | 12/1995 | WIPO . |

*Primary Examiner*—Henry Bennett
*Assistant Examiner*—Steve Gravini
*Attorney, Agent, or Firm*—Roylance,Abrams,Berdo & Goodman, L.L.P.

[57] ABSTRACT

The invention is directed to a process and apparatus for drying a slurry, particularly a sludge, such as sewage sludge, in which a sludge mixture of recycled dried sludge and wet sludge is fed to a drier. The quantity of wet sludge or recycled dried sludge supplied to the drier is controlled based upon drier inlet temperature. In this way, the evaporation rate of the drier is kept substantially constant.

25 Claims, 1 Drawing Sheet

PROCESS AND APPARATUS FOR DRYING A SLURRY

BACKGROUND OF THE INVENTION

1. Field of the Invention

The invention refers to a process and apparatus for drying a slurry, particularly a sludge, such as sewage sludge, in which a sludge mixture of recycled dried sludge and wet sludge is fed to a drier to dehydrate the sludge mixture utilizing hot exhaust air from a furnace. The quantity of wet sludge or recycled dried sludge fed to the drier is controlled based upon the drier inlet temperature.

2. Description of the Prior Art Processes for drying sludge have been known in the art, for example, as described in WO 93/24800 or U.S. Pat. No. 5,069,801. In these processes, the furnace temperature and the drier inlet temperature, respectively, are controlled in response to changing dry content levels in the sludge mixture. As a result, the drier inlet temperature has to be lowered when the dry solids content of the sludge mixture fed into the drier increases (i.e., when the sludge mixer fed into the drier contains less water). This causes a decrease in drying performance since the drier inlet temperature is lower. If a wetter sludge mixture is fed into the drier, the drier inlet temperature has to be increased. However, the furnace is limited in capacity, and when the furnace reaches its upper limit, adequate drying can only be achieved by reducing throughput, which usually must be effected by manual intervention.

This invention addresses these problems in the art by providing a process and apparatus in which the operating conditions of the drier are kept substantially constant by using a control system according to the present invention.

SUMMARY OF THE INVENTION

According to the present invention, the quantity of fresh slurry, such as wet sludge, and/or the quantity of the dried slurry, such as recycled dried sludge, fed into a drying zone are controlled in response to the drier inlet temperature, i.e., substantially the temperature of the hot exhaust gas entering the drier. In this way, changes in the wet sludge data are compensated for by changing the quantity of solids in the sludge mixture fed into the drier to maintain the evaporation rate of the drier substantially constant. As used herein, "evaporation rate" refers to the amount of water evaporated per unit time, for example, it can be defined in terms of kilograms per hour. As used herein, the expression "constant evaporation rate" means that independent of changes in the nature of the feed sludge, the evaporation rate of the drier remains constant according to the present invention. As used herein, the term "wet sludge data" refers mainly to the dry content and/or moisture content of the wet sludge entering the system, but also refers secondarily to the composition of the wet sludge, for example, the amount of organic/inorganic particles in the wet sludge entering the system that can influence the drying process.

The process of the present invention for drying a sludge mixture comprises the steps of feeding a mixture of wet sludge and recycled dried sludge to a drier; introducing hot exhaust gas from a furnace zone into the drier to dehydrate the sludge mixture; and controlling the quantity of the wet sludge fed into the drier based on the drier inlet temperature. According to another aspect of the present invention, the quantity of recycled dried sludge entering the drier is controlled based on the drier inlet temperature.

The sludge drying system of the present invention includes several operating sections, such as a drying section and a separation section, as in U.S. Pat. No. 5,309,849, which is totally incorporated herein by reference.

The present invention also includes an apparatus comprising a drier having an inlet for receiving hot exhaust gas and for receiving a mixture of wet sludge and dried sludge and first and second control means for controlling the quantity of the wet sludge and dried sludge, respectively, entering the drier, based on drier inlet temperature. The apparatus also includes temperature measuring means, such as a temperature probe, which measures the drier inlet temperature and sends a signal to first and second control means in response to a change in drier inlet temperature. Each control means, in response to the signal sent by the temperature probe, either increases or decreases the quantity of wet sludge or recycled dried sludge fed to the drier, respectively.

More specifically, the control system of the present invention comprises temperature measuring means for measuring the inlet temperature of the hot exhaust gas entering the drier. This temperature measuring means sends a signal in response to a change in inlet temperature to a motor of the control means of the wet sludge, such as a feed screw, which controls the quantity of wet sludge that enters the drier. This temperature measuring means also sends a signal in response to a change in drier inlet temperature to a motor of the control means of the recycled dried sludge, such as a feed screw, which controls the quantity of recycled dried sludge that enters the drier. In this way, the speed of each feed screw can be adjusted in response to the signal sent from the temperature measuring means.

This control system of the present invention ensures that there is the same quantity of water in the drier to be evaporated, thereby keeping the operating conditions of the drier constant.

BRIEF DESCRIPTION OF THE DRAWING

The FIGURE is a schematic of a sludge drying system having the control system according to an embodiment of the present invention.

DETAILED DESCRIPTION OF THE INVENTION

Figure 1:
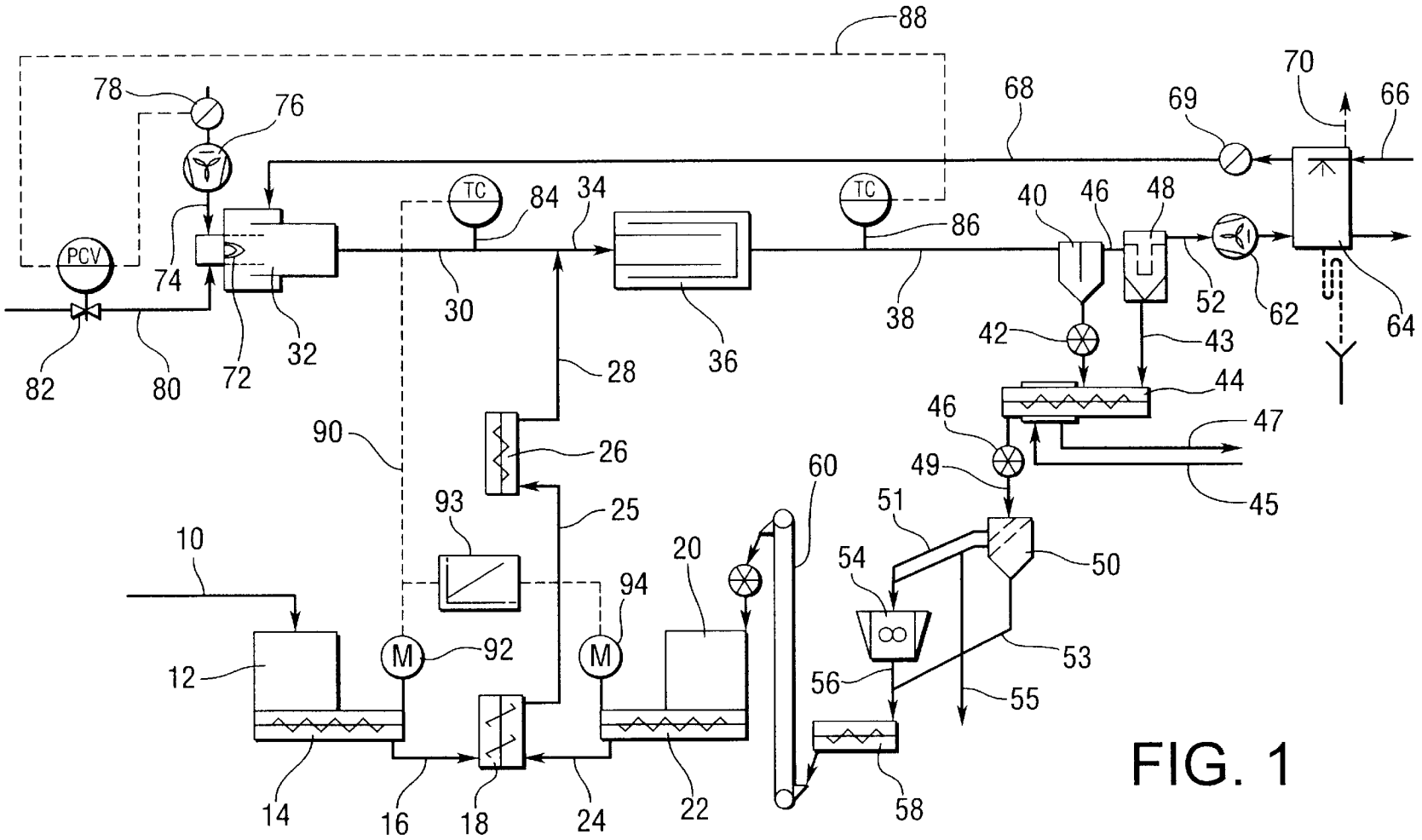

Referring now to the FIGURE, a sludge drying system is shown in accordance with an embodiment of the present invention. Dewatered sludge from a press or centrifuge (not shown) is introduced by line 10 to silo 12.

The wet sludge from silo 12 is conveyed by dosing device or feed screw 14 through line 16 to mixer 18.

Meanwhile, recycled dried sludge from silo 20 is conveyed by dosing device or feed screw 22 through line 24 to mixer 18.

Mixer 18 mixes wet sludge with recycled dried sludge to form a sludge mixture. The sludge mixture of wet sludge and recycled dried sludge is then conveyed by line 25 to feed screw 26 and discharged into line 28. Meanwhile, hot exhaust gas discharged from furnace 32 is conveyed by line 30 where it contacts the sludge mixture from line 28. The hot exhaust gas and sludge mixture are introduced by means of line 34 into drier 36. The moisture from the sludge mixture is absorbed into the hot exhaust gas conveyed into drier 34 from furnace 36. Drier 34 may be a drum drier, fluidized bed, or disc drier.

The dried sludge is then discharged from drier 36 together with hot, wet process gas or off-gases by means of line 38, and introduced into air-solids separator or cyclone 40 for separating the process gas from the dried sludge. The separated dried sludge is then passed through rotary vane feeder 42 to screw conveyor 44. Cooling water is fed by line 45 into a mantle around the screw of screw conveyor 44 to cool the sludge product which exits drier 36 at a temperature of approximately 80°° to 100° C. The water leaves the screw conveyor by means of line 47.

Finer particles of dried sludge that remain in the process gas after cyclone 40 travel to filter 48 by line 46. Filter 48 separates the finer particles of dried sludge from the process gas. These finer particles are then fed also to screw conveyor 44 by line 43. The process gas is discharged from filter 48 by line 52 and is free of dried sludge particles.

The dried sludge particles are then fed from screw conveyor 44 to screening plant 50 by means of rotary valve 46 and line 49. Screening plant 50 sorts or classifies the dried sludge particles. The coarse material or oversized particles are discharged from screening plant 50 by means of line 51 to crusher 54. Granulate having a desired grain size is also fed through line 51 to line 55 to packing and transport devices. As an option, a partial flow of the granulate having a desired grain size can also be fed to crusher 54 via line 51. The finest dried sludge particles are conveyed from screening plant 50 via line 53 to line 56 where the finest dried sludge particles are combined with the dried sludge particles leaving crusher 54 via line 56.

Line 56 conveys the combined dried sludge particles to screw conveyor 58. Screw conveyor 58 conveys the dried sludge particles to conveyor lift 60, then to recycled dried sludge silo 20.

The hot wet process gas is conveyed through line 52 via fan 62 to washer/condenser 64. Cooling water is introduced to washer/condenser via line 66. The washed and cooled dry process gas exits washer/condenser 64 by means of line 68, and its flow is regulated by valve 69. A partial flow of process gas is emitted into the atmosphere from washer/condenser 64 via line 70.

The process gas in line 68 is recycled to furnace 32. In furnace 32, the recycled process gas is mixed with fresh air entering furnace 32 via line 74. The mixture of fresh air and recycled process gas are then heated in furnace 32 and conveyed through line 30 to drier 36 for drying the sludge mixture entering drier 36. As an alternative, the process gas in line 68 can be heated before it reaches the furnace 32 by a heat exchanger (not shown). In this alternate situation, the recycled process gas is heated using an indirect heating system in which the recycled process gas is passed through a heat exchanger. The heat source for the heat exchanger may be either exhaust air from a burner or a thermal oil system (not shown). Indirect heating of recycled product gas is shown in FIG. 2 of WO 93/24800, this reference being incorporated herein by reference in its entirety.

Furnace 32 includes burner 72. Fresh air is introduced to furnace 32 via line 74 by fan 76. The supply of fresh air is controlled by damper 78. Fuel is introduced to furnace 32 via line 80. The supply of fuel is controlled by valve 82. The fuel used can be either gas or oil.

As part of the control system of the present invention, a temperature probe 84 is used to measure the drier inlet temperature, which substantially corresponds to the temperature of the exhaust gas entering drier 36 by line 30.

Another temperature probe 86 is used to measure the drier outlet temperature of the hot, wet process gas and dried sludge mixture leaving drier 36 by line 38. In order to achieve a desired inlet temperature of exhaust gas entering drier 36 by line 30, a signal from temperature probe 86 by signal line 88 is used to control both valve 82, which in turn controls the quantity of fuel introduced into furnace 32, and damper 78, which in turn controls the quantity of fresh air introduced into furnace 32.

In order to achieve a substantially constant evaporation rate in drier 36, a signal from temperature probe 84 via signal line 90 is used to control both 1) speed-adjustable motor 92, which in turn controls the speed of the feed screw 14, which in turn controls the quantity of wet sludge introduced to mixer 18 via line 16, and 2) speed-adjustable motor 94, which in turn controls the speed of the feed screw 22, which in turn controls the quantity of recycled dried sludge introduced to mixer 18 by line 24.

Block diagram 93 represents a conventional control including a computer database, for example, stored in memory that will output a signal for a desired drive speed for motor 92 and/or motor 94 to regulate throughput of wet or dried sludge, respectively, in response to a particular temperature from temperature probe 84, while referencing wet sludge data.

Due to the control system according to the present invention whereby the wet sludge quantity is controlled by the drier inlet temperature, the wet sludge throughput will vary even if there is only a very slight change in drier inlet temperature. The drier inlet temperature and thus, the evaporation rate of drier 36 can be kept substantially constant. If a sludge mixture is fed into drier 36 via line 34 having a higher dry solids content, i.e., less water, the drier inlet temperature falls due to a drop in evaporation heat required. Using temperature probe 84, according to the present invention, a signal is sent by signal line 90 to speed-adjustable motor 92 of feed screw 14 to increase the throughput of wet sludge from silo 12 introduced into mixer 18 and then into drier 36. This ensures that there is always the same quantity of water in the drier to be evaporated.

In the opposite case, if a sludge mixture from mixer 18 is fed into drier 36 via line 34 having a lower dry solids content, i.e., more water, the drier inlet temperature rises due to an increase in evaporation heat required. According to the present invention, a control signal is sent from temperature probe 84 by signal line 90 to speed-adjustable motor 92 of feed screw 14 to cause the feed screw 14 to rotate more slowly to therefore decrease the throughput of wet sludge introduced into drier 36. This method also ensures that the quantity of water to be evaporated remains constant.

In order to set a desired drier capacity, a suitable drier outlet temperature can be pre-set for the drier. This in turn affects the drier inlet temperature since temperature probe 86 is used to achieve a desired drier inlet temperature as discussed previously. If the quantity of wet sludge fed into the drier to be dried is small, and if it is possible to save energy, and to cut emissions by reducing the energy output at the furnace, the evaporation rate of the drier can be reduced by lowering the drier inlet temperature. When the drier inlet temperature is changed in this way, temperature probe 84 transmits a signal via signal line 90 to speed-adjustable motor 94 of feed screw 22, which reduces the quantity of recycled dried sludge conveyed to mixer 18 and fed to drier 36.

In this way, the dry solids content of the sludge mixture entering drier 36 is reduced so that a lower evaporation rate of drier 36 is required. As a result, a constant dry solids content is achieved and the quantity of sludge mixture fed into drier 36 is reduced.

EXAMPLE

The control system of the present invention is illustrated employing the conditions set forth in Table 1 and Table 2 below. The percentages are by weight.

TABLE 1

| | | | | |
|---|---|---|---|---|
| Wet sludge | Dry Content, % | 25 | 23 | 27 |
| | Amount, kg DS/h* | 340 | 307 | 382 |
| Recycled dried sludge | Amount, kg DS/h | 1870 | 1870 | 1870 |
| Drier inlet temp., ° C. | | 450 | 450 | 450 |
| Drier outlet temp., ° C. | | 90 | 90 | 90 |

*DS/h = dry solids

In the tests of Table 1, the dry solids content of the wet sludge varies, and according to this variation in the dry solids content of the wet sludge, the amount of wet sludge is controlled so as to keep the drier inlet temperature, the drier outlet temperature, and the evaporation of water constant. For example, as the dry content drops from 25% to 23%, as shown above, the amount of wet sludge is decreased so as to keep the drier inlet temperature, the drier outlet temperature, and therefore, the evaporation rate constant.

TABLE 2

| | | | | |
|---|---|---|---|---|
| Wet sludge | Dry Content, % | 25 | 25 | 27 |
| | Amount, kg DS/h* | 288 | 239 | 382 |
| Recycled dried sludge | Amount, kg DS/h | 1860 | 1545 | 1870 |
| Drier inlet temp., ° C. | | 400 | 350 | 450 |
| Drier outlet temp., ° C. | | 90 | 90 | 90 |

*DS/h = dry solids

Table 2 shows the effect on the amount of recycled dried sludge in relation to the drier inlet temperature. If the evaporation rate of the drier should be changed, the inlet temperature has to be changed. In response to the change in inlet temperature, the amount of recycled dried sludge will be changed, and, as the evaporation rate changes, also the amount of wet sludge will be adjusted with respect to the dry content. The drier inlet temperature, however, is a set value.

While several embodiments have been shown to illustrate the present invention, it will be understood by those skilled in the art that various modifications and changes can be made therein without departing from the scope of the present invention as defined in the appended claims. For example, it is possible to use thermal oil to heat the recycled process gas instead of a burner or to use other plant components.

What is claimed is:

1. A process of drying sludge, comprising:

feeding a mixture of wet sludge and dried sludge to a drier;

supplying hot gas from a furnace to said drier to dehydrate said mixture of wet sludge and dried sludge;

measuring an inlet temperature of said hot gas at an inlet of said drier; and controlling the quantity of wet sludge fed into said drier in response to changes in said inlet temperature of said hot gas.

2. The process of claim 1, wherein said dried sludge is recycled dried sludge.

3. The process of claim 1, further comprising controlling said quantity of said wet sludge fed into said drier based on said inlet temperature to maintain an evaporation rate in said drier substantially constant.

4. The process of claim 1, further comprising:

controlling the quantity of dried sludge fed into said drier based on said inlet temperature of said hot gas.

5. The process of claim 1, further comprising:

utilizing a dosing device for controlling said quantity of wet sludge fed into said drier.

6. The process of claim 4, further comprising controlling said quantity of said dried sludge fed into said drier based on said inlet temperature of said hot gas to maintain an evaporation rate in said drier substantially constant.

7. The process of claim 4, further comprising:

utilizing a dosing device for controlling said quantity of dried sludge fed into said drier.

8. The process of claim 1, wherein said hot exhaust gas is a mixture of fresh air and recycled process gas.

9. The process of claim 8, wherein said recycled process gas is heated by a heat exchanger or thermal oil.

10. The process of claim 1, wherein said drier is a drum drier, a fluidized bed, or a disc drier.

11. A process for drying a slurry, comprising:

feeding a mixture of wet slurry and dried slurry to a drier;

supplying hot gas from a furnace to said drier to dehydrate said mixture of wet slurry and dried slurry;

measuring an inlet temperature of said hot gas at an inlet of said drier; and controlling the quantity of wet slurry fed into said drier in response to changes in said inlet temperature of said hot gas.

12. The process of claim 11, wherein said dried slurry is recycled dried slurry.

13. The process of claim 11, further comprising:

controlling the quantity of said dried slurry fed into said drier based on said inlet temperature of said hot gas.

14. Apparatus for drying sludge, comprising:

a drier having an inlet for receiving hot exhaust gas and for receiving a mixture of wet sludge and dried sludge;

a first temperature measuring device for measuring an inlet temperature of said hot exhaust gas into said drier;

a first control operatively coupled to said temperature measuring device for controlling the quantity of said wet sludge received by said drier in response to changes in said inlet temperature of said hot exhaust gas.

15. The apparatus of claim 14, wherein said dried sludge is recycled dried sludge.

16. The apparatus of claim 14, further comprising:

a second control for controlling the quantity of said dried sludge received by said drier in response to changes in said inlet temperature of said hot gas.

17. The apparatus of claim 16, wherein said first temperature measuring device comprises:

a temperature probe for measuring said inlet temperature of said hot exhaust gas at said inlet of said drier and for sending a signal to said first or second control in response to said change in said inlet temperature of said hot exhaust gas.

18. The apparatus of claim 17, wherein said first or second control is a dosing device responsive to said signal from said temperature probe.

19. The apparatus of claim 14, wherein said hot exhaust gas is a mixture of fresh air and recycled process gas.

20. The apparatus of claim 19, wherein said recycled process gas is heated by a heat exchanger or thermal oil.

21. The apparatus of claim 14, wherein said drying means is a drum drier, a fluidized bed, or a disc drier.

22. The process of claim 1, further comprising measuring an outlet temperature of gas exiting said drier; and adjusting said inlet temperature of said hot gas in response to a change in said outlet temperature of gas from said drier to maintain a substantially constant outlet temperature.

23. The process of claim 22, further comprising controlling the quantity of wet sludge fed to said drier to maintain a substantially constant rate of evaporation in said drier.

24. The apparatus of claim 14, further comprising a second temperature measuring device for measuring an outlet temperature of gas exiting said drier; and a second control for controlling the inlet temperature of said hot exhaust gas in response to a change in said outlet temperature of gas exiting said drier.

25. The apparatus of claim 24, wherein said first control adjusts a feed rate of said wet sludge into said drier to maintain a substantially constant rate of evaporation in said drier.

* * * * *